US006425820B1

(12) United States Patent
Kennedy et al.

(10) Patent No.: US 6,425,820 B1
(45) Date of Patent: Jul. 30, 2002

(54) MINE DOOR POWER DRIVE SYSTEM

(75) Inventors: William R. Kennedy; John M. Kennedy, both of Taylorville, IL (US)

(73) Assignee: Jack Kennedy Metal Products and Buildings, Inc., Taylorville, IL (US)

( * ) Notice: Subject to any disclaimer, the term of this patent is extended or adjusted under 35 U.S.C. 154(b) by 0 days.

(21) Appl. No.: 09/538,199

(22) Filed: Mar. 30, 2000

(51) Int. Cl.[7] ..... E06B 7/16; E21F 1/12; E21F 1/14

(52) U.S. Cl. ..... 454/169; 49/118; 49/368; 405/144

(58) Field of Search ..... 49/118, 123, 367, 49/368; 52/126.4, 217; 405/132, 141, 143, 144, 147, 150.1; 454/168, 169

(56) References Cited

U.S. PATENT DOCUMENTS

| | | | | |
|---|---|---|---|---|
| 807,290 A | | 12/1905 | Krzyzanowski et al. | |
| 898,343 A | | 9/1908 | Durack | |
| 1,100,690 A | | 6/1914 | Ramsay | |
| 1,261,924 A | | 4/1918 | Grasty et al. | |
| 1,322,923 A | | 11/1919 | Meisel | |
| 2,564,067 A | | 8/1951 | Karp | 268/1 |
| 2,926,012 A | | 2/1960 | Maher | 268/16 |
| 3,125,232 A | | 3/1964 | Brinkman et al. | 214/17 |
| 3,261,050 A | | 7/1966 | Caille et al. | 15/311 |
| 3,831,318 A | | 8/1974 | Richmond | 49/31 |
| 4,222,147 A | | 9/1980 | Burnett, Jr. | 16/62 |
| 4,375,735 A | | 3/1983 | Rhoads | 49/68 |
| 4,481,887 A | | 11/1984 | Urbano | 413/499 |
| 4,911,577 A | * | 3/1990 | Kennedy et al. | 405/152 |
| 5,222,838 A | * | 6/1993 | Kennedy et al. | 405/302 |
| 5,240,349 A | | 8/1993 | Kennedy et al. | 405/132 |

FOREIGN PATENT DOCUMENTS

| | | | | |
|---|---|---|---|---|
| GB | 2255948 A | * | 11/1992 | E21F/1/14 |
| GB | 2291668 A | * | 1/1996 | E21F/1/10 |

OTHER PUBLICATIONS

MSHA Regulation 30 CFR 18.34.*
MSHA Regulation 30 CFR 75.340.*

* cited by examiner

*Primary Examiner*—William Neuder
*Assistant Examiner*—Jennifer H Gay
(74) *Attorney, Agent, or Firm*—Senniger, Powers, Leavitt & Roedel

(57) ABSTRACT

A mine door system including at least two doors positioned in a mine passageway in spaced relation forming an airlock. The doors include at least one leaf movable between open and closed positions to allow passage into and out of the airlock. A control system controls operation of leaf movement actuators such that in normal operation, at least one door is always closed to control flow of air in the mine. A power source is included to effect movement of the leafs by the actuators.

41 Claims, 9 Drawing Sheets

CONTINUED ON FIG. 7B

FIG. 7B
CONTINUED FROM FIG. 7A
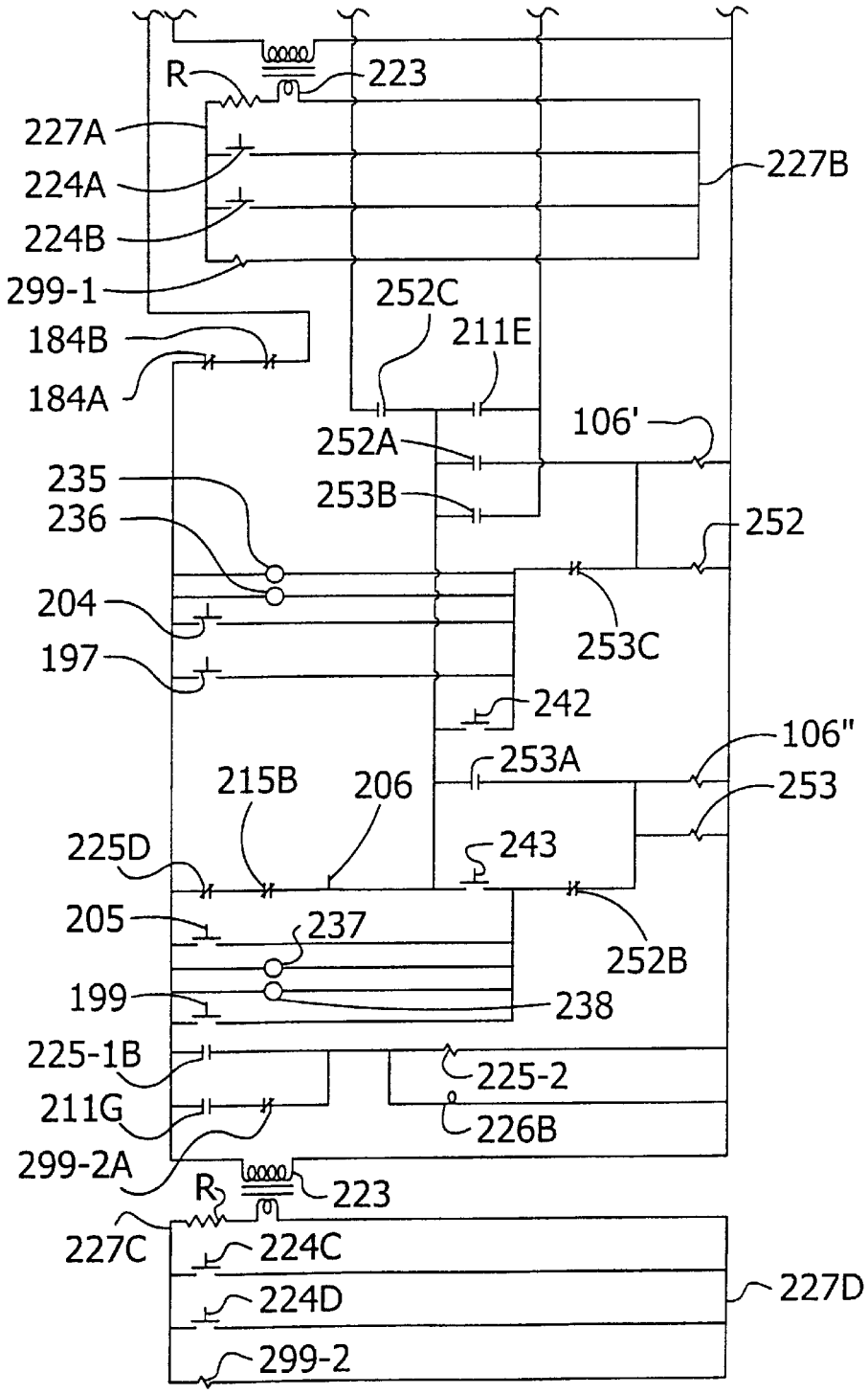

MINE DOOR POWER DRIVE SYSTEM

BACKGROUND OF THE INVENTION

The present invention relates to a mine door operating system usable with two or more mine doors such as in an airlock arrangement.

Doors used in mines operate under conditions not usually encountered by typical doors. Mine doors have door leafs that tend to be heavy and dimensionally large and are thus subject to large forces due at least in part to air flow in the mine and consequent air pressure differentials on opposite sides of a door. A leaf can be as large as 10 feet wide and 20 feet high and sometimes even larger and weigh more than a thousand pounds when designed for pressure differentials of seven inches of water gauge and over two thousand pounds for a pressure differential of 20 inches of water gauge. The leafs can thus be subject to large forces from the air pressure differential on opposite sides of the leafs. Even a small pressure differential can create large forces on the large leafs making it difficult to control their movement during opening and closing and difficult to start opening movement and complete closing. Further, leafs need to be positively driven particularly in the closing direction to prevent door runaway and impact when the leafs reach the end of their closing movement, particularly when the closing movement is toward the low pressure end of the mine, the normal condition. Continued impact and runaway would cause damage and premature wear to the leaf drive, leaf and door frame.

Additionally, to reduce the risk of damage and to improve safety, it would be desirable to simply and reliably lock the leafs in both the open and closed positions and at any position in-between should there be a power outage or in the event the leaf encounters an obstruction during movement. It would also be desirable to be able to manually override the locked condition of any leaf.

Air locks are provided in mines to allow vehicles and personnel to pass thru mine passageways while controlling air flow between passageways or through a passageway and/or for fire prevention and control. Air locks use at least two doors of the above described type, a mine side or return air side door and a mine entrance or fresh air side door. In some mines, e.g., coal mines, air locks are mandatory under government regulations. In an air lock, at least two doors are spaced apart along a mine passageway with one door being located at the mine end of the air lock and the other door being located at the entrance side (in some cases this side is referred to as the fresh air side and is upstream relative to normal air flow) of the air lock. FIG. 11 illustrates, in simplified form, a coal mine. The mine includes an air intake passageway (AIP) with an air inlet opening (AI) connected to a mine face passageway (MFP) to provide fresh air to the mine face. In normal operation, fresh air flows to the mine face thru the intake passageway. An air outlet opening (AO) is connected to the mine face via a air exit passageway (AEP). Air flowing across the mine face from the air intake is discharged through the air outlet. A neutral passageway (NP) connects the mine face to the exterior of the mine and is commonly in parallel to the air intake passageway and the air exit passageway. The neutral passageway provides for normal passage of personnel, machinery and mined material between the mine face and the mine exterior. In some locations in a mine, e.g., the air intake passageway AIP the doors of an airlock, AL, will all be considered to be fresh air (designated FA) side doors even though one of the doors is more adjacent the mine face than another door. All doors of an airlock AL may also be considered to be return air (RA) side doors even though one door is more adjacent the exit than another door, e.g., in an air exit passageway AEP, as defined by regulatory authorities. The neutral passageway has an airlock AL. The airlock in a neutral passageway is considered to have all doors in fresh air. Airflow, for normal operation is from the entrance, high pressure side of the mine, the air intake to the air outlet, the low pressure side of the mine. The pressure differential and flow rate in a neutral passageway are low relative to those in air intake passageways and air outlet passageways. In normal operation, one door of an air lock remains closed while the other door is open to allow movement into or out of the air lock while preventing air flow therethrough. Air lock doors need to be power operated for personnel convenience and to also manage movement of large leafs and the forces applied to the leafs due to the aforementioned pressure differentials. Since the normal air flow in a mine may reverse, the doors and leaf drives are preferably able to accommodate the reversal of force direction on the leafs and still properly operate. Also, the leafs are preferably positively held in the open and closed positions and in any position in-between where the leafs may be stopped.

Current leaf drive systems typically use a separate leaf drive for each door with each door utilizing a separate power source. The use of multiple power sources has been found to be desirable because the hydraulic piping is short which provides quicker response of the leaf drive and less play or give in the drive system. Such a system also utilizes two separate control systems each operating a respective door and requiring a separate housing for the power source and its control system. Further, when the doors are interlocked, the control system utilizes the interlock switches of one door to provide a signal that it is or is not permissible to open the leafs of the other door. The control systems are not interconnected providing an opportunity for the leafs of the multiple doors to malfunction since the controllers are not interconnected.

Leaf drive systems like those used with air locks, even though generally effective, do have drawbacks. They use power sources at separate locations, e.g., hydraulic pumps, each with their own control system also at separate locations. The separate control systems would need to be interfaced to effect proper and safe operation particularly with regard to interlocking so that one door cannot be opened unless the other door is closed. Another problem is having control circuit components on the mine side of the fresh air side door, i.e. in return air. When the second door is in return air, the air lock chamber is part of the return air side of the air lock and in some mine environments, like coal mines, will have to have sealed (explosion proof) components to eliminate ignition sources. Explosion proof as used herein means that a device such as a motor or component housing will not let ignited combustion products out of the device. Mine regulations as promulgated by MSHA (Mining Safety and Health Administration) refer to such equipment as "permissible" and regulate what will meet the standards of permissible. MSHA designates what equipment is permissible in particular environments. What is permissible or explosion proof will vary by the environment in which the equipment will be used. For example, what is permissible in a lead mine will not necessarily by permissible in a coal mine where methane may be present. If a combustible gas like acetylene is potentially present, equipment that is permissible for a methane environment may not be permissible in the acetylene environment. For environments where combustibles may be present, e.g., methane, meeting the requirements of "permissible" increases the cost of enclosures for control circuit components. Any motor powering, e.g., a motor driving a hydraulic pump needs to be explosion proof if it is positioned on the mine side of the fresh air side door, i.e. in return air, when in a mine environment possibly containing combustible gases like coal mines which can contain methane, as set forth in mining regulations. Also, the use of multiple pumps increases the cost of the leaf drive system and increases the fire hazard by having more potential ignition sources.

Another problem with the use of multiple door drive systems is the performance of maintenance work. A maintenance worker will lock out the equipment being worked on. However, if all the leaf drive systems in a multiple power source system are not locked out, there is a chance that the worker could be injured by a non-locked out leaf if that leaf moves while the worker is in the path of leaf movement.

There is thus a need for a simplified leaf drive system that provides effective and positive safe door operation in both the opening and closing directions of movement while reducing problems encountered with current door drive systems using multiple power sources while permitting the use of non-explosion proof (non-permissible, i.e., that which does not meet the standards of permissible) components.

SUMMARY OF THE INVENTION

Among the several objects and features of the present invention may be noted the provision of a drive system for multiple mine doors that utilizes a single source of power to open and close the mine door leafs; the provision of a door drive system that positively moves the leafs between open and closed positions; the provision of a door drive system that will positively maintain the leafs at any stopped position; the provision of a door drive system with an override to permit selective movement of leafs from a locked position; the provision of a door drive system that will positively maintain leafs in open and closed positions; the provision of a door drive system that prevents one door from opening while the other door is open or opening; the provision of a door operating system that can be safely utilized in a potentially explosive mine environment; the provision of a door operating system that reduces the number of potentially explosion causing components on the mine side of a fresh air side door of an air lock formed by the doors; the provision of a door operating system that is economical and effective in controlling leaf opening and closing; the provision of a door operating system that can be safely maintained; the provision of a door operating system that prevents leaf runaway; and the provision of a door operating system that will reduce the risk of fire and explosion in a mine.

In one aspect of the invention, a power operated mine door system forms an airlock space with a fresh air side on at least one side of the mine door system. The mine door system includes a plurality of doors mounted in a mine passage in spaced apart relation. Each door includes at least one leaf mounted for moving between open and closed positions. The doors form an airlock with an airlock space therebetween. At least one door is a return air side door and at least one door is a fresh air side door. A single source of pressurized fluid includes a non-explosion proof motor and a fluid pump driven by the motor. The motor is positioned in the mine passage on the fresh air side of the fresh air side door. A plurality of actuators are each operably connected to at least one leaf and to the single source of pressurized fluid to selectively apply a driving force to at least one leaf and thereby move the leaf between the open and closed positions. A control system is operably connected to the actuators for selectively allowing pressurized fluid to flow to the actuators for applying the driving force to a selected leaf for moving it to its open and closed positions.

The invention also involves the provision of a power operated mine door system installed in a mine passageway defining an airlock in the passageway separating a normally low pressure zone of the mine having a first air pressure and a normally high pressure zone of the mine having a second air pressure higher than said first air pressure. The system includes at least two doors installed in the passageway in spaced apart relation along the passageway forming an airlock and having an airlock space therein. The doors are operable to provide entry into and exit from the airlock space. The doors each include a pair of leafs movable between open and closed positions, one of the doors is located at a high pressure end of the airlock with its leafs being mounted for opening movement into the high pressure zone and another of the doors is located at a low pressure end of the airlock. A piston cylinder is operably connected to each of the leafs and is operable for moving at least one leaf between its open and closed positions. Each piston cylinder has a movable actuating element connected to a respective leaf for selectively exerting an opening force on the leaf to open it, a closing force on the leaf to close it and is operable to positively retain the leaf in its open and closed positions. A control system is operably connected to the piston cylinders for controlling the operation of the piston cylinders such that when one piston cylinder exerts an opening force to open the at least one leaf in one door, the at least one piston cylinder connected to the at least one leaf in the other door is operable to retain its at least one leaf closed whereby only one of said doors can have a leaf open at any given time. The control system is operable to selectively positively retain each said leaf in its closed position despite the different first and second air pressures. A fluid pump is positioned in the mine and operably connected to the piston cylinders for pumping pressurized fluid to and from the piston cylinders to power the piston cylinders to selectively open and close the leafs.

The present invention involves the provision a door system for a mine. The door system includes at least one leaf mounted for pivotal movement between open and closed positions. A power actuator is operably connected to the leaf and is operable to move the leaf between the open and closed positions. A power source is operably connected to the power actuator to provide pressurized fluid thereto to effect operation of the power actuator and thereby move the leaf between the open and closed positions. A control system is operably connected to the power source and the actuator to effect selective extension and retraction of the power actuator and to effect locking of the leaf in the open and closed positions and at positions therebetween.

An aspect of the present invention is the provision of a power operated mine door system forming an airlock space between a high pressure side and a low pressure side of the mine door system. The mine door system includes a plurality of doors mounted in a mine passage in spaced apart relation, each door including at least one leaf mounted for moving between open and closed positions. The doors form an airlock with an airlock space therebetween. A single source of pressurized fluid including at least one motor and at least one fluid pump driven by the motor, the source being positioned on one side of a door. A plurality of actuators are each operably connected to a respective leaf and to the single source of pressurized fluid to selectively apply a driving force to a respective leaf and thereby move the leaf between said open and closed positions and to selectively retain the respective leaf in its open position and closed position. A single electrical control system operably connected to the actuators and the source for selectively allowing pressurized fluid to flow to the actuators for applying said driving force to a selected leaf for moving it to its open and closed positions. The control system includes an interlock device including a sensor operably associated with each leaf to provide a signal that the respective leaf is closed and preventing opening of a leaf in one door if any leaf in another door is not closed.

The invention also involves the provision of a power operated mine door system forming an airlock space between a high pressure side and a low pressure side of the mine door system. The mine door system includes a plurality of doors mounted in a mine passage in spaced apart relation, each door including at least one leaf mounted for moving between open and closed positions, the doors forming an airlock with an airlock space therebetween. A source of pressurized fluid including at least one motor and at least one a fluid pump driven by a motor, the source being positioned on one side of one door. A plurality of actuators each operably connected to at least one leaf and to the source of pressurized fluid to selectively apply a driving force to at least one leaf and thereby move the leaf between said open and closed positions and to selectively retain the respective leaf in its open position and closed position. A single control system operably connected to the actuators and said source for selectively allowing pressurized fluid to flow to the actuators for applying the driving force to at least one leaf for moving it to at least one of its open and closed positions. The control system includes an interlock device including a sensor operably associated with each leaf to provide a signal that the respective leaf is closed and preventing opening of a leaf in one door if any leaf in another door is not closed. The single control system includes a signal receiving portion mounted in a single housing enclosing the signal receiving portion therein.

Another aspect of the invention involves a power operated mine door system forming an airlock space between a high pressure side and a low pressure side of the mine door system. The mine door system comprises a plurality of doors mounted in a mine passage in spaced apart relation, each door including at least one leaf mounted for moving between open and closed positions. The doors form an airlock with an airlock space therebetween. A source of pressurized fluid including at least one motor and at least one fluid pump driven by a said motor. The source is positioned on one side of a door. A plurality of actuators are each operably connected to at least one leaf and to the source of pressurized fluid to selectively apply a driving force to at least one leaf and thereby move the leaf between said open and closed positions and to selectively retain the at least one leaf in its open position and closed position. A single control system is operably connected to the actuators for selectively allowing pressurized fluid to flow to the actuators for applying driving force to a selected leaf for moving it to at least one of its open and closed positions. The control system includes an interlock device including a sensor operably associated with each leaf to provide a signal that the respective leaf is closed to prevent opening of a leaf in one door if any leaf in another door is not closed. The single control system includes a signal receiving portion mounted in a single housing enclosing the signal receiving portion therein.

Other objects and features will be in part apparent and in part pointed out hereinafter.

BRIEF DESCRIPTION OF THE DRAWINGS

FIGS. 7A and 7B include a schematic ladder diagram of the electrical control circuit for the leaf drive system;

Corresponding reference characters indicate corresponding parts throughout the several views of the drawings.

DETAILED DESCRIPTION

Figure 1:
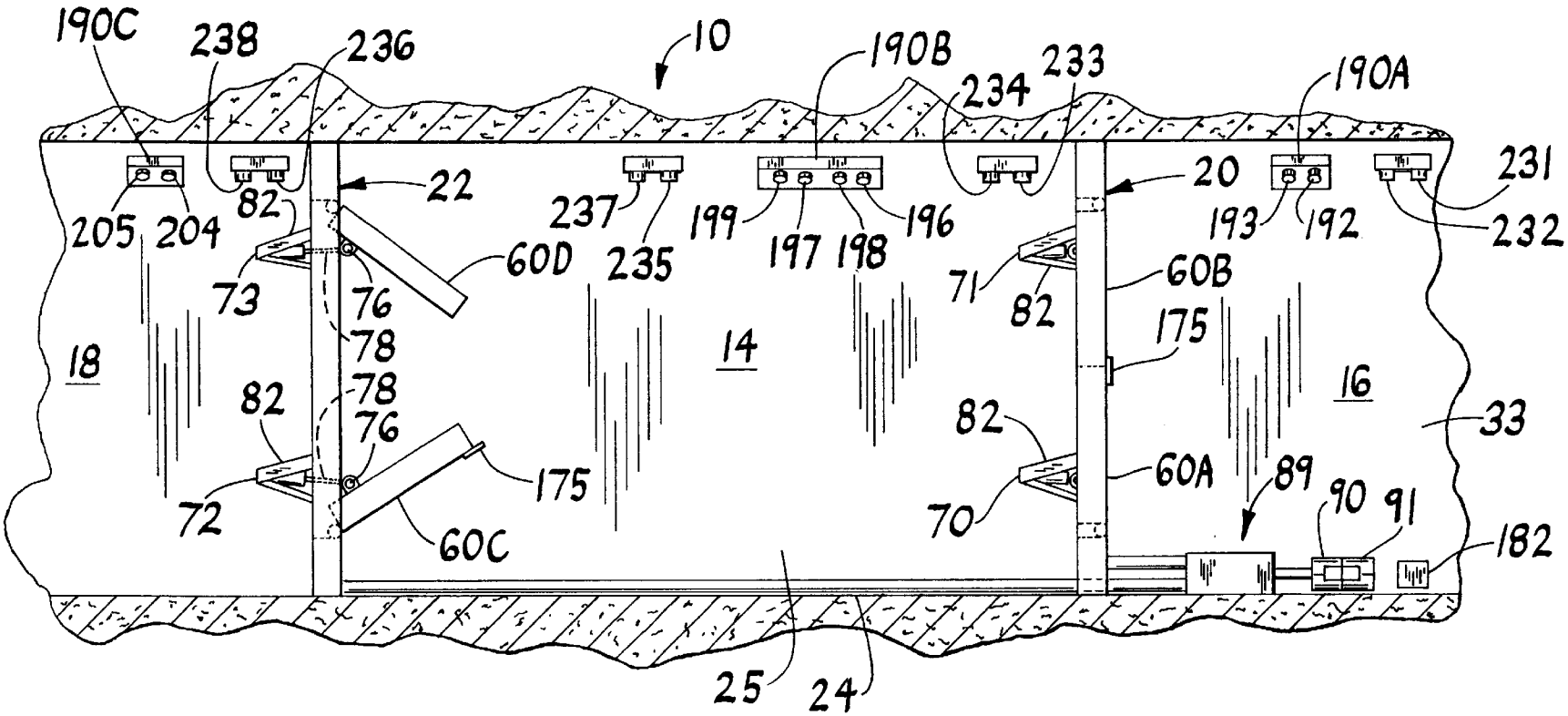
FIG. 1 is a plan view of an air lock door system in a mine passageway showing a fresh air side door closed and the return air side door open.
Figure 11:
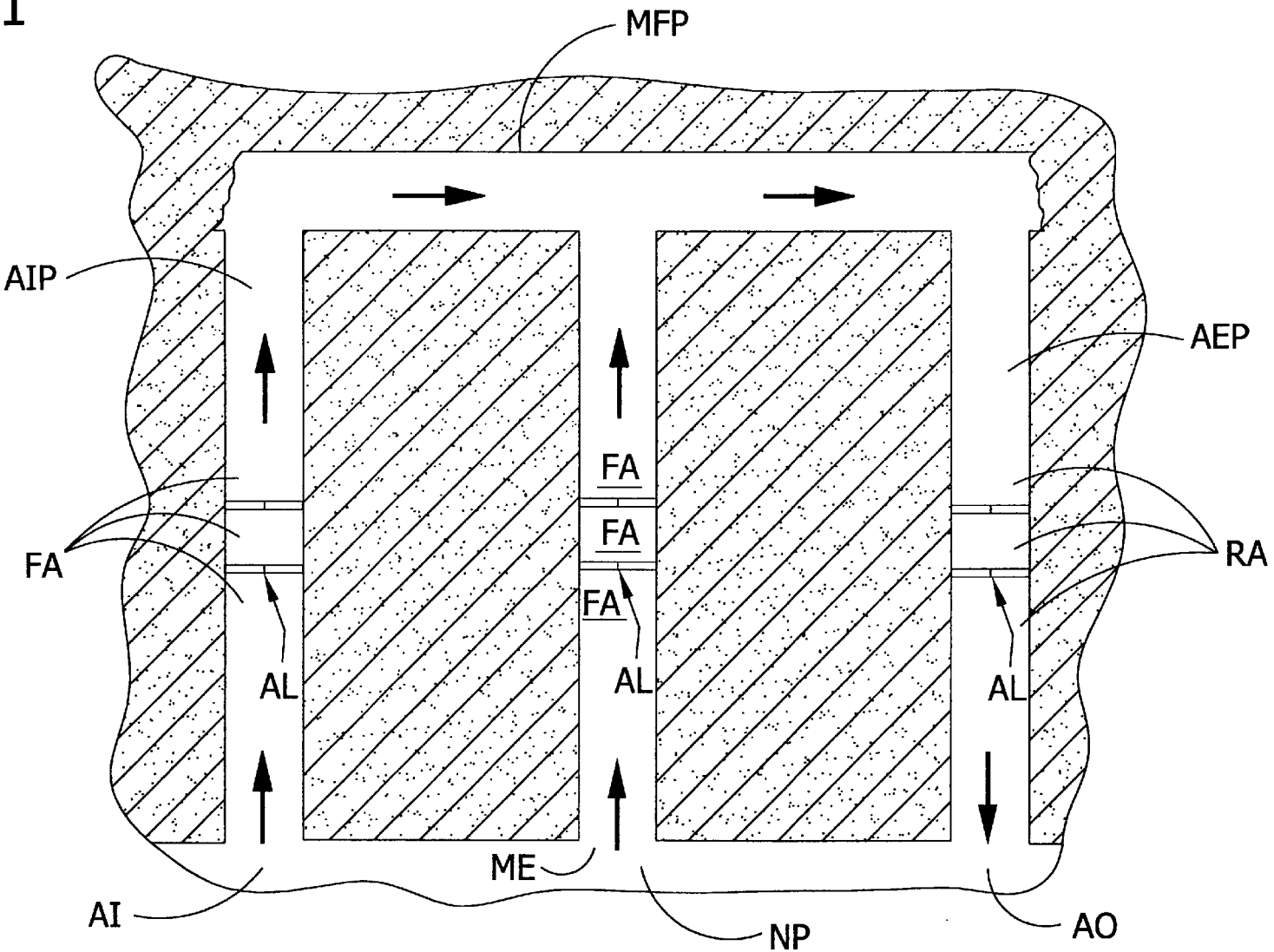
FIG. 11 is a schematic plan view of a mine such as a coal mine showing one layout of various passageways and doors.

FIG. 1 illustrates a mine door system designated generally as 10. The mine door system is erected in a mine passageway 14 that has a high pressure or fresh air side zone 16 and a low pressure or return air side zone 18. In normal mine operation, the high pressure side 16 (which is in fresh air) is the side most adjacent the mine entrance ME or in a passageway that during normal flow of air does not receive air that has passed along the mine face and the low pressure side 18 is the side of the mine door system 10 closest to the mine face where ore or mineral is being mined. In an inlet passageway which extends from the air inlet to the mine face, both doors are in fresh air as regards regulations with the door most adjacent the entrance being the high pressure side door and the door most adjacent the mine face being a low pressure side door. Mines like coal mines, also have one or more air exhaust passageways, and in such a passageway, all doors will be considered to be in return air and will thus be return air side doors. In an airlock in an exhaust air passageway, the door closest the mine face will be on the high pressure side and the door closest the air outlet will be on the low pressure side. Mines will also have one or more passageways (referred to as neutrals) extending between the mine entrance ME and the mine face passageway MFP. In the configuration of FIG. 11, all the doors of the air lock in the neutral passageway NP are in fresh air. In some mines, certain passageways can have an airlock wherein one door of an airlock will be in fresh air and the other door in return air with the space between the doors being considered to be in return air. In the case of a neutral passageway, at times, there may be little if any pressure differential on the doors during normal operation however, the door most adjacent the entrance passageway is the high pressure side door and the door most adjacent the exit passageway is a low pressure side door. Most traffic in a coal mine is in a neutral passageway. The airlock as described and shown herein, is described as being in a neutral passageway. For some aspects of the present invention, the airlock of the present may be in any type of mine passageway or between different types of passageways. The mine door system 10 prevents or reduces air flow from the fresh air side 16 of the mine door system 10 to the mine interior. Importantly, the mine door system 10 also forms a fire break. The mine door system 10 includes a plurality of generally rectangular doors shown as a pair of doors 20, 22 spaced apart along the mine passageway and defining an airlock 24 with an airlock space 25 between the doors 20, 22. As shown, there are two doors 20, 22, however, any suitable number of doors of two or more can be used. For example, in a wye configured set of passageways, three doors could be used. The door 20 is on normally high pressure side and the door 22 is on the normally low pressure side. The air lock 24 provides for control of air flow thru the mine passageway 14 by keeping the low pressure side 18 separate from the high pressure side 16. In some constructions, this will keep fresh air separate from return air, the neutral passage separate for return passageways and intake passageways separate from neutral passageways, etc.

Figure 2:
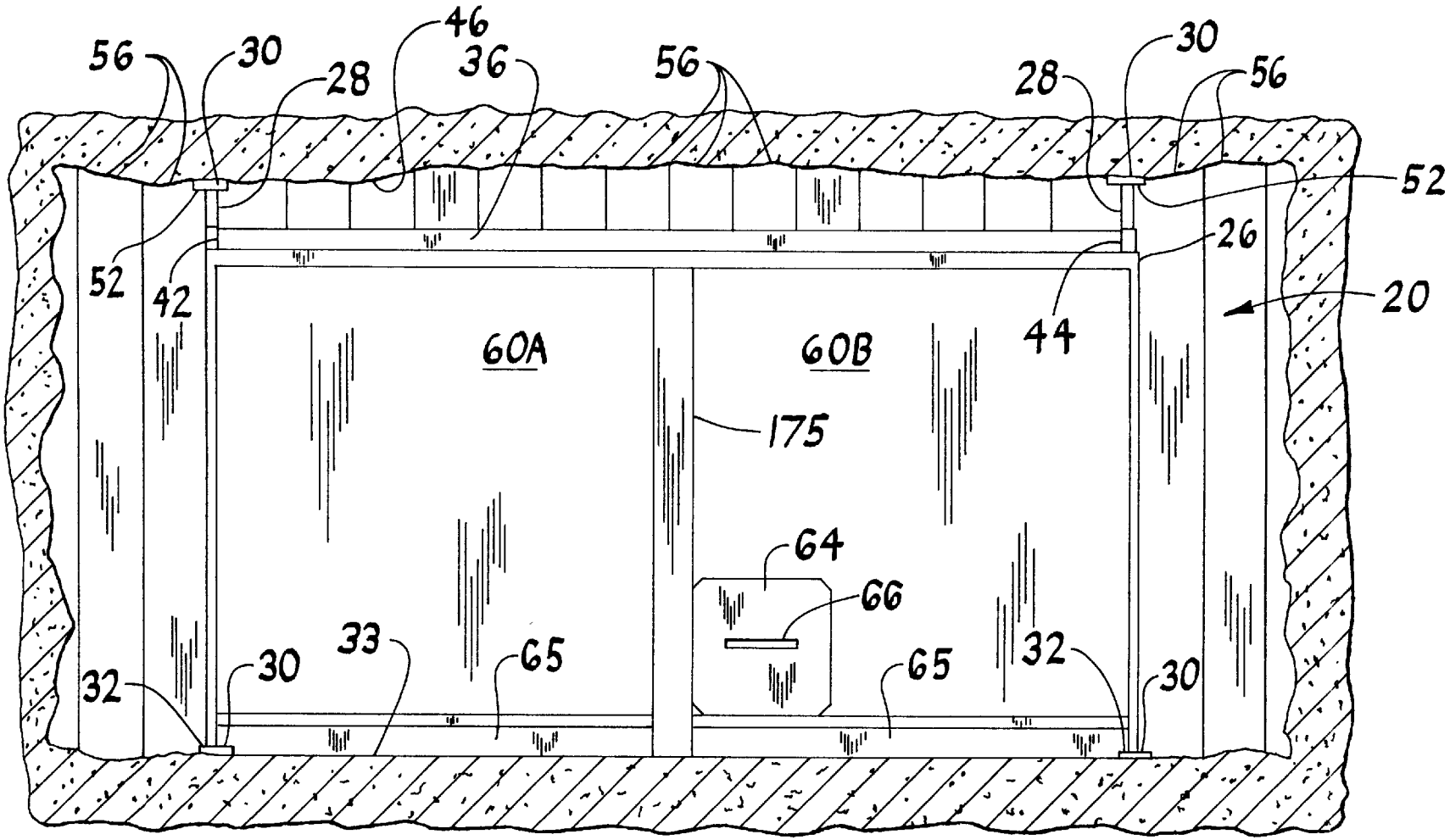
FIG. 2 is a front elevation view of a door in a mine passageway.
Figure 3:
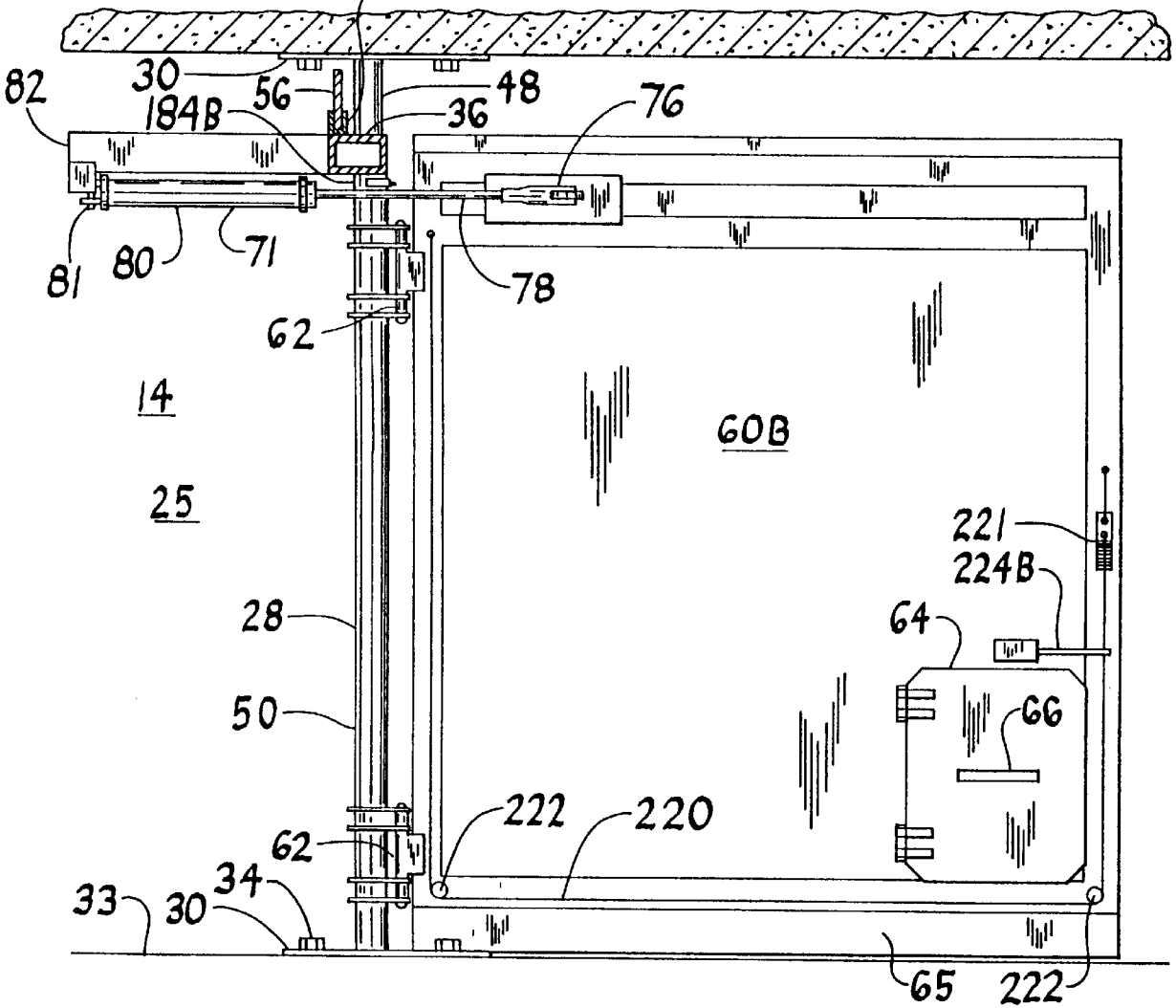
FIG. 3 is a side elevation view of one leaf and leaf drive of the air lock system erected in a mine passageway with the leaf open.

The doors 20, 22 can have similar or identical construction. The door 20 will be described, and its description applies to the door 22. The door 20 can be of any suitable construction such as that disclosed in U.S. Pat. No. 5,240,349 to Kennedy et al., the disclosure of which is incorporated herein by reference. As seen in FIGS. 2 and 3, the door 20 includes a door frame 26 comprising a pair of spaced apart generally vertical door jambs which in a preferred embodiment are columns 28 secured to the mine floor via plates 30. The plates 30 are attached to the lower ends 32 of the columns as by welding and to the mine floor 33 by mechanical fasteners 34 such as anchor bolts. The door frame also includes a lintel 36 secured to the columns 28 and extends between the columns. The lintel 36 may include an upwardly opening channel 37 (FIG. 3). The lintel 36 may be secured to the columns 28 in any suitable manner. In a preferred embodiment, sleeves (not shown) are secured adjacent to opposite ends 42, 44 of the lintel and can slide up and down on the columns 28 as is known in the art. The sleeves are secured in place on the columns with T-handled set screws (not shown) also as known in the art. Preferably, the columns 28 are of adjustable length to extend between the mine floor 33 and mine roof 46. As shown in FIG. 3, each column 28 includes a tubular upper section 48 telescopingly received in a tubular lower section 50. The two sections are secured in adjusted position by T-handled set screws (not shown), for example. Upper ends 52 of the columns 28 are secured to the mine roof 46 by plates 30. These plates 30 are secured to the columns 28, as by welding, and to the roof 46 as with mechanical fasteners 34 such as anchor bolts. Stopping panels 56 can be erected around the door frame 26 as is known in the art and as shown in U.S. Pat. No. 5,240,349. The panels 56 above the lintel 36 will have their lower ends retained in the channel 37 as seen in FIG. 3. The stopping panels seal the mine passageway 14 around the door frame 26 from air flow past the doors 20, 22. Alternately, a masonry wall, gunite, plate steel, concrete, etc., could be used in place of the stopping panels.

The door 20 includes at least one door leaf, and is illustrated as being, two leafs 60 (designated 60A, B for door 20 and 60C, D for door 22 for clarity). Each leaf 60A–D is hingedly mounted on a respective column 28 to pivotally move about a generally vertical axis. As shown, each leaf 60A–D is hingedly mounted via at least two hinges 62 secured to a respective column 28. A supplemental man door 64 can be hingedly mounted on one or more of the leafs 60 to provide for ingress to and egress from the air lock space 25 by personnel without having to open any of the leafs 60A–D. The door 64 is releasably retained closed by a latch 66. When the leafs 60 A, B are closed, they are generally coplanar. Further, a seal flap 65 can be secured to the bottom edge of each leaf to prevent air flow between the leafs 60 A–D and the mine floor 33.

It is preferred that the leafs 60A–D are hinged to move toward the high pressure side 16 of the passageway 14 to an open position. In the case of the leafs 60C, D of the door 22, the leafs will open into the air lock space 25 of the air lock 24, and in the case of the door 20, the leafs 60A, B will open away from the air lock and into the high pressure side 16 of the passageway 14. Thus, the leafs 60A–D move toward the high pressure side 16 of the passageway 14. However, it is envisioned that the leafs 60A, B of the door 20 could move into the air lock space 25 of the air lock 24 instead of into the high pressure side 16 of the passageway 14, and the leafs 60C, D of the door 22 could move into the low pressure side of the passageway 14 instead of into the air lock space 25. Further, all leafs 60A–D can open into the air lock space 25 or all could open out of the air lock space.

Figure 5:
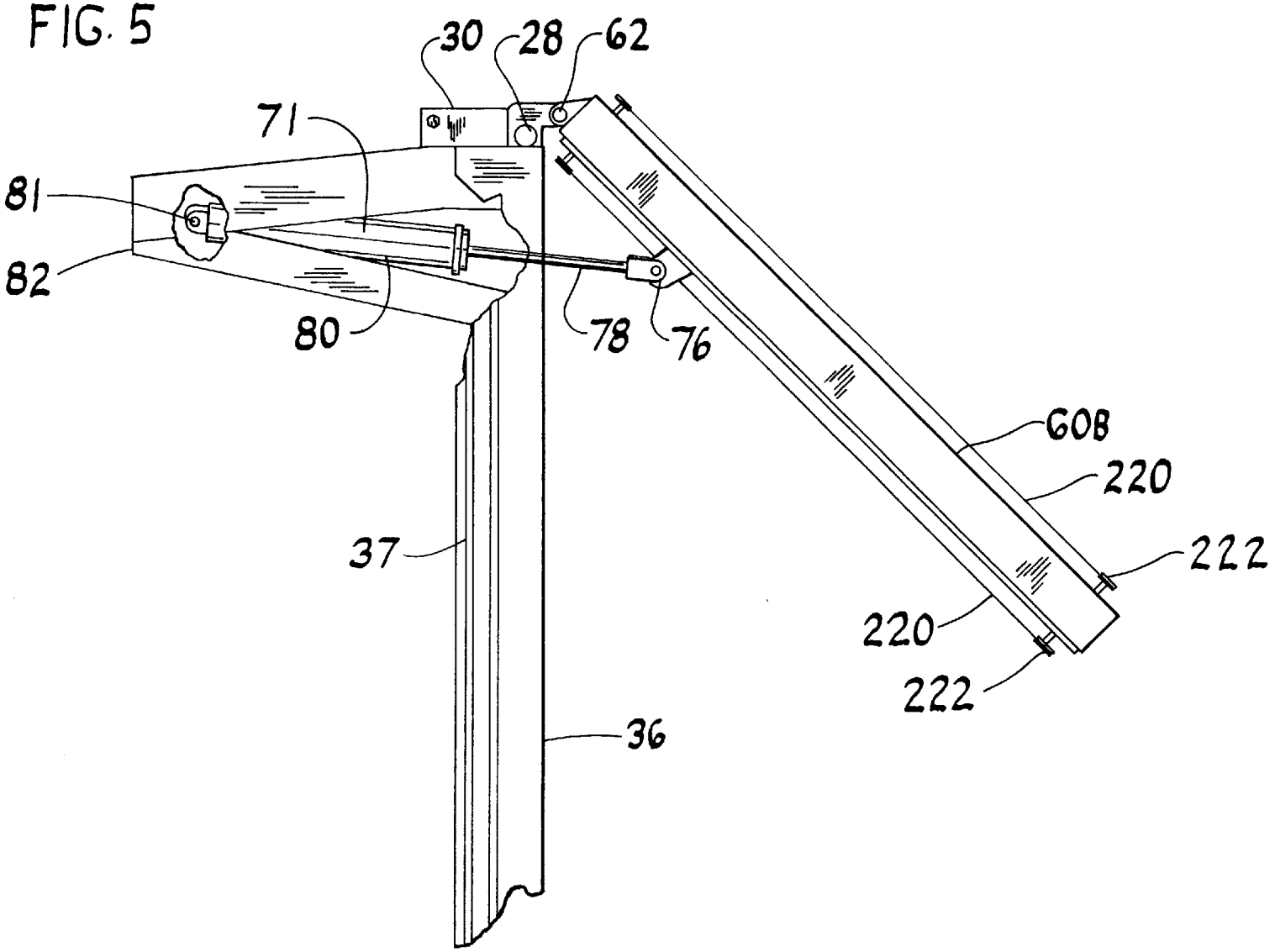
FIG. 5 is a fragmentary plan view of a leaf and leaf drive with the leaf partly open.

As seen in FIGS. 1, 3, and 5, drive means is associated with each leaf 60A–D to effect its movement between open and closed positions. In a preferred embodiment, the drive means includes power actuators which preferably are extensible piston cylinders 70, 71, 72, 73, each being pivotally mounted to a respective leaf 60A–D via pivots 76 such as a clevis pivoted to a lug secured to each of the leafs adjacent an upper edge of the leaf adjacent the vertical axis of the door. A preferred cylinder is model JK 17327 available from Kennedy Metal Products & Buildings, Inc. of Taylorville, Ill. Alternatively, one cylinder can be used to power both leafs in one door by being operatively connected directly to one leaf and to the other leaf via a tie rod arrangement. The cylinders 70–73 are preferably double acting piston cylinders extendable and retractable with pressurized fluid, which in a preferred embodiment is pressurized hydraulic fluid. The cylinders 70–73 each have a rigid moveable actuator element such as a piston rod 78 that can both positively push and pull a leaf. The cylinders 70–73 each have a rigid piston housing 80 in which the piston rod 78 is moveably mounted for reciprocal linear motion therein. It is envisioned that the cylinders could also be single acting spring return cylinders in certain mine environments, e.g. where air pressure differentials are low. The cylinders 70–73 are also pivotally connected to respective doors 20, 22, preferably at the lintels 36. As shown in FIG. 3, a pair of brackets 82 is secured to the lintels 36, and the piston housings 80 are each pivotally mounted to a respective bracket 82 at pivot connection 81 such as a clevis type mount. Extension of a cylinder 70–73 moves the respective leaf 60A–D to an open position and retraction of a cylinder 70–73 moves the respective leaf to a closed position. The cylinders 70–73 are operable to apply force to the leafs 60A–D to move the leafs to the open positions by positively pushing the leafs and the closed positions by positively pulling the leafs. The cylinders also provide a reaction force to retain the leafs in the open and closed position despite the forces on the leafs from air pressure differentials or the like.

Figure 6:
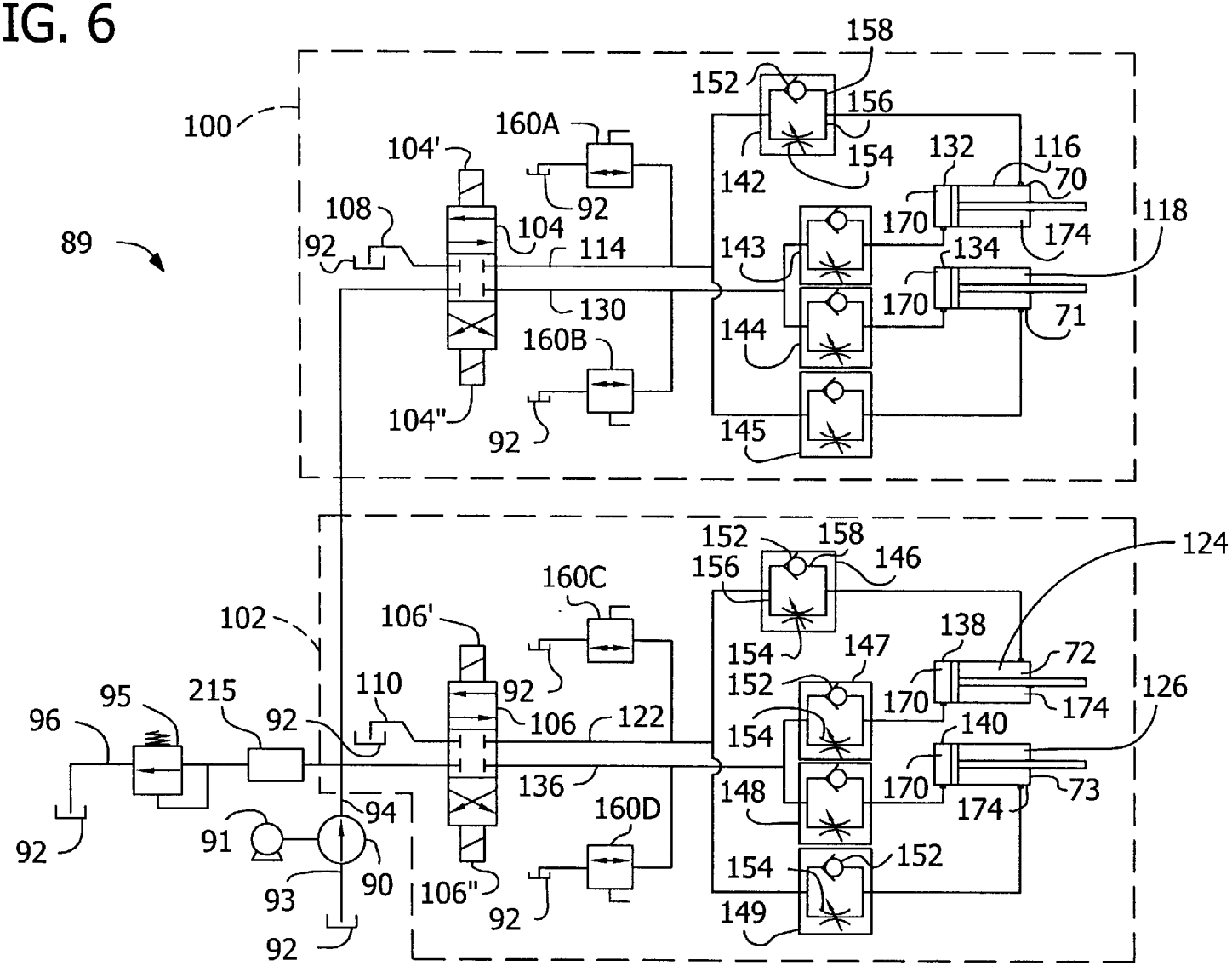
FIG. 6 is a schematic diagram of a hydraulic circuit of the leaf drive system.

FIG. 6 shows a preferred hydraulic system, designated generally 89, for effecting selective movement and locking in place of the cylinders 70–73. In an alternate embodiment, the hydraulic system 89 could be a pneumatic system and the components thereof would be pneumatic instead of hydraulic. A preferred pressurized fluid source is a motor driven hydraulic pump 90 which in some embodiments is positioned in the passageway 14, as best seen in FIG. 1, on the fresh air side 16. The pump 90 is operably connected to the cylinders 70–73 to pump pressurized fluid to and from the cylinders to effect their selective extension and retraction. A preferred pump 90 is a two stage gear pump available as model MP-JK406663 from Jack Kennedy Metal Products & Buildings, Inc. of Taylorville, Ill. The pump 90 is driven by an electric motor 91, which is non-explosion proof (non-permissible) because it is positioned in the fresh air side 16. In one embodiment of the present invention, a single source of pressurized fluid is provided and is located on one side of one door preferably on the fresh air side of an airlock that also has return air on the other side. The single source in one embodiment can take the form of one motor operably connected to one pump. In other embodiments, the single source can also be one motor connected to a plurality of pumps or a plurality of motors each connected to one or more pumps. The single source has the pump(s) and motor (s) at one location as herein described. Preferably, when possible, the single source is located on a fresh air side of the airlock. In one embodiment, the pump(s) 90 and motor(s) 91 are mounted in a housing preferably in the same housing 182 as an electrical control circuit hereafter described for enclosing the pump 90 and motor 91 and protect them from exposure to the mine environment. The housing 182 can be explosion proof if desired, but is preferably non-explosion proof. The pump 90 is connected in flow communication with a source or reservoir 92 of hydraulic fluid via a conduit 93. The pump 90 is also connected in flow communication, via a conduit 94, to a pressure relief valve 95 which is in turn connected in flow communication with the source 92 via a conduit 96. Should hydraulic pressure become too high, the relief valve 95 will allow pressurized hydraulic fluid to vent to the source 92 through conduit 96 until the valve closes at a preset pressure, thereby limiting the system pressure at a predetermined level. Each door 20, 22 has a separate hydraulic operation control system section 100, 102 respectively. The two control system sections 100, 102 are the same in the illustrated preferred embodiment. The control system section 100 effects and controls movement of the cylinders 70, 71 and the control system section 102 effects and controls movement of the cylinders 72, 73. With the exceptions of the cylinders 70–73 and the valves 160A–D hereafter described, the control system sections 100, 102 are mounted in the housing 182.

The control systems sections 100, 102 are each connected in flow communication with the pump 90 via the conduit 94. Each control system section 100, 102 includes a flow control valve 104, 106 respectively. Each valve 104, 106 is connected in flow communication to the source 92 via conduits 108, 110 respectively for return of hydraulic fluid. A preferred valve type for the valves 104, 106 is a 4-way solenoid activated spring return spool valve which moves to or remains in a blocked port position when any of its solenoids are not energized. A conduit 114 connects the valve 104 in flow communication with the rod sides 116, 118 of the cylinders 70, 71, respectively, and a conduit 122 connects the valve 106 in flow communication with the rod sides 124, 126 of the cylinders 72, 73 respectively. A conduit 130 connects the valve 104 in flow communication with the back or piston sides 132, 134 of the cylinders 70, 71, respectively, and a conduit 136 connects the valve 106 in flow communication with the back or piston sides 138, 140 of the cylinders 72, 73 respectively.

Fluid flow regulators 142–149 in the conduits 114, 122, 130, 136 regulate flow of pressurized hydraulic fluid to and from the cylinders 70–73. The flow regulators 142, 145, 146 and 149 are similar in construction and operation and the flow regulators 143, 144, 147 and 148 are similar in construction and operation in the illustrated embodiment. Each includes a check valve 152 and a variable flow control valve 154 connected in flow communication in parallel via conduits 156, 158 respectively in a respective conduit 114, 122, 130, 136. The operation of the flow regulators for each cylinder is the same and will be described with regard to the flow regulators 142, 143 for the cylinder 70, which description applies to the cylinders 71–73 as well. The check valve 152 in the flow regulator 143 is oriented to allow free (unregulated) flow of pressurized fluid to the chamber 170 of the cylinder 70 while the check valve 152 in the flow regulator 142 is oriented to provide regulated flow of fluid from the chamber 174 of the cylinder 70 thru its variable flow control valve 154. Thus, the cylinder 70 will extend at regulated speed since flow of fluid from the cylinder is regulated upon extension. During retraction of the cylinder 70 the check valve 152 of the flow regulator 142 is oriented to force the pressurized fluid to flow thru the variable flow control valve 154 of the flow regulator 142 to the chamber 174, and the check valve 152 of the flow regulator 143 forces the exhausting fluid in the chamber 170 to flow thru the variable flow control valve 154 of the flow regulator 143. Thus, the closing and opening speed of the leaf is regulated by two variable flow control valves 154 ensuring control of closing and opening speed. Alternately, the flow regulators 142–149 may have the valves oriented to control the opening speed only or the closing speed only. In a preferred embodiment, the leafs 60A, B in the door 20 close at different speeds so one will reach its closed position before the other. The leafs 60 C, D also close at different speeds. The retraction speeds of the cylinders 70–73 can be independently adjusted to predetermined speeds via adjustment of the flow rate through the valves 154. Alternatively, movement of one of the leafs 60 A, C could start before movement of the other leaf 60 B, D respectively. This permits the use of an astragal 175 (sealing flap) secured to each of the leafs 60A, C that will overlap the leaf 60B, D respectively to seal the gap therebetween. The astragals 175 are preferably made of fire resistant reinforced rubber. Hydraulic fluid flow regulation during cylinder retraction will help prevent leaf runaway during closing and also reduce impact between the leaf and door frame at closing. Also, the cylinders 70–73 can be of a cushion type, preferably a double cushion type (a cushion for extension and for retraction) to lessen impact at each end of the cylinder stroke.

The leafs 60A–D may be locked in the open and/or closed positions if desired or at any position in-between. Locking is accomplished by moving the spool in the appropriate control valve 104, 106 to a position where the fluid flow ports are closed, which is the center position as seen schematically in FIG. 6. Preferably, the valves 104, 106 are spring biased to the blocked port (center) position. Thus, at any time that either of the solenoids on a valve 104, 106 is not activated or energized, the spool will move to the blocked port (center) position. Fluid then cannot be exhausted from either side of a cylinder, thereby locking the cylinder and hence the respective leaf in position despite air pressure differentials on the leaf. Reactive force can thus be applied to the leafs 60A–D if the leafs try to move when locked. The cylinders 70–73 resist the movement of respective locked leafs positively retaining or locking the leafs in position. Dump valves 160A–D can be connected in the pressure lines between the valves 104, 106 and the respective cylinders 70–73 to allow manual release of doors from their locked conditions by venting the line and cylinder to source 92.

Figure 7A:
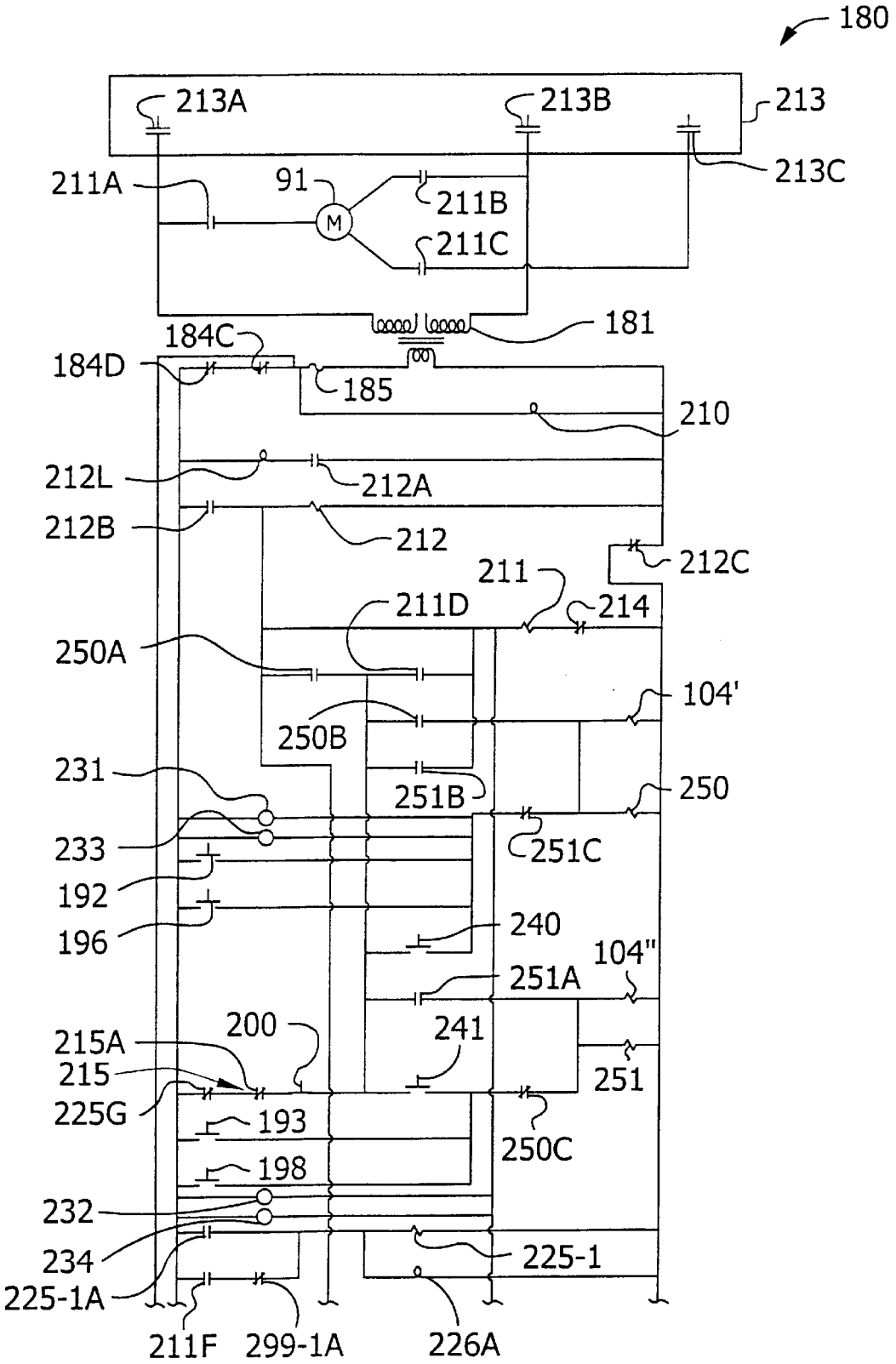

FIGS. 7A and 7B show an electrical circuit 180 which in combination with the hydraulic system 89 forms a control system operable to control movement of the leafs 60A–D and operation of the motor 91 and the pump 90. The circuit 180 is shown in a de-energized state with the motor 91 off. Preferably, the circuit 180 is contained in one housing 182. However, more than one housing could be used if desired. In a preferred embodiment, the pump 90 and motor 91 are also enclosed in a housing as described above, preferably a sealed or explosion proof housing if not in a fresh air location. It is further preferred that the pump 90, motor 91, the various valves of the above disclosed hydraulic circuit 89 and a portion of the circuit 180 be mounted in a single housing 182 to enclose them and protect them from exposure to the mine environment. The portion of the circuit 180 in the housing is preferably the portion that receives and processes signals, hereafter referred to the signal receiving portion, from remote control signal senders as hereinafter described. As seen in FIG. 1, a housing 182 is mounted on a fresh air side such as the high pressure side 16 of the air lock 24 to reduce the hazard of explosion from spark ignition. This eliminates the need for an explosion proof housing 182 allowing it to be non-permissible or non-explosion proof. A step down transformer 181 provides reduced voltage current (preferably about 120V AC) to the control elements described below. It is also preferred that the circuit 180 utilize low voltage, e.g., 24 volts, where practicable to further reduce the risk of spark ignition and shock to personnel. Alternatively, many of the control elements hereinafter described, could be pneumatic to eliminate the risk of electrical sparking therein. The control circuit 180 controls operation of the valves 104, 106 and the motor 91. The valves 104 and 106 are solenoid operated valves having open solenoids 104' and 106', respectively, and close solenoids 104" and 106", respectively. One feature of the control circuit 180 is that it, in a single control circuit, provides interlock between the doors 20, 22 such that when the leafs 60A, B are open or opening, the leafs 60C, D must be closed and vice versa. The control circuit 180 includes interlock switches 184A–D that are each mounted preferably on the lintel 36 (FIG. 3) for actuation to form a closed circuit when the respective leaf 60A–D is in its closed position and an open circuit when a leaf is open or opening. Thus, when one or both leafs in a door 20 or 22 are not closed, the leafs in the other door 22, 20 cannot open. A fuse 185 is also provided to prevent overloading portions of the control circuit 180.

Figure 10:
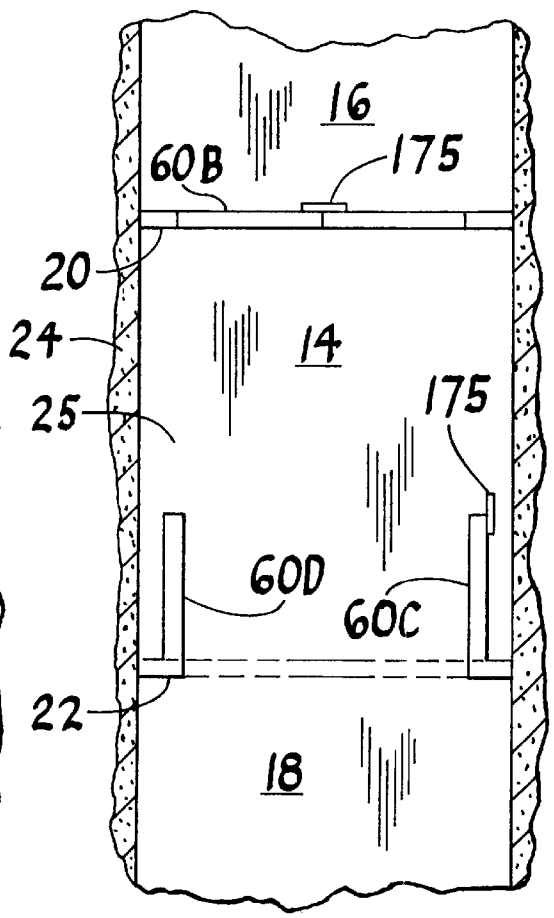
FIG. 10 is a schematic plan view of the air lock door system showing the leafs of the fresh air side door closed and the return air side door open.
Figure 9:
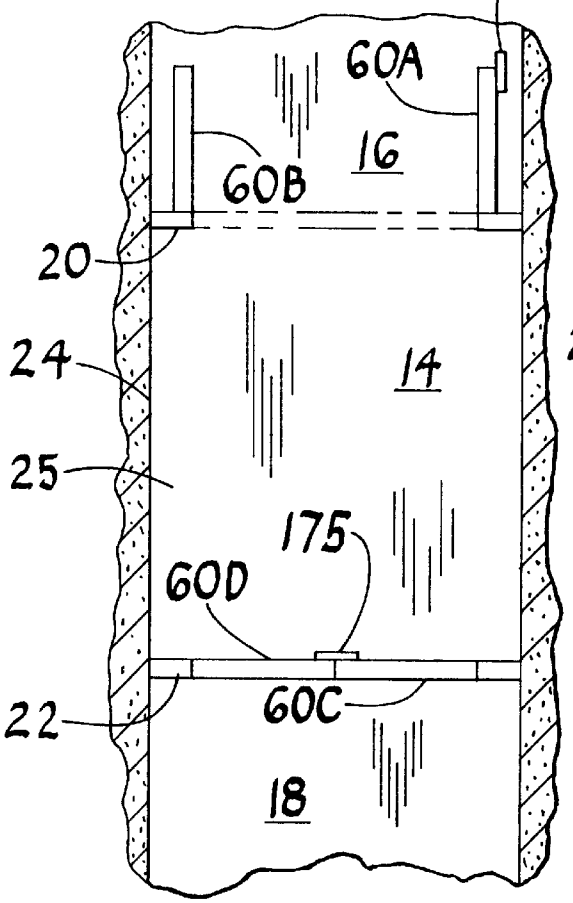
FIG. 9 is a schematic plan view of the air lock door system showing the leafs of the fresh air side door open and the return air side door closed.
Figure 8:
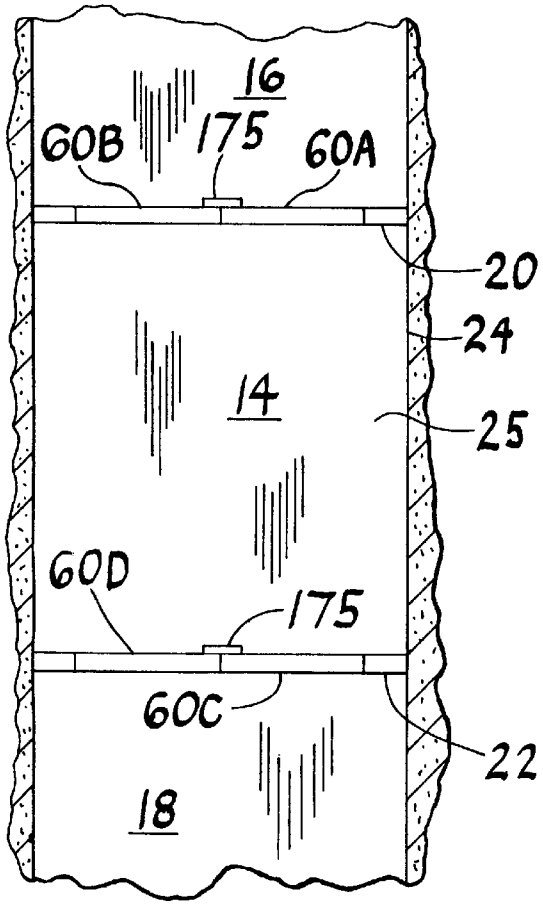
FIG. 8 is a schematic plan view of the air lock door system showing the leafs of both doors in their closed positions.

As seen in FIGS. 1, 7A, and 7B, there are two means to generate signals for opening and closing of the leafs 60A–D during normal operation. There are three sets of manual pushbutton switches 190A, 190B, 190C (FIG. 1). The set 190A is positioned on the fresh air side 16 and located such that personnel operating the switches will be out of the path of movement of the leafs 60A, B. The switch set 190A contains a leaf open switch 192 and a leaf close switch 193. The open switch 192, when it makes a circuit, activates the solenoid 104' and runs the motor so that the cylinders 70, 71 extend and move the leafs 60A, B to their open positions (FIG. 9). The close switch 193, when it makes a circuit, activates the solenoid 104" and runs the motor so that the cylinders 70, 71 retract and move the leafs 60A, B to their closed positions (FIGS. 8, 10). The switch set 190B is located in the air lock space 25 and includes two leaf open switches 196, 197 and two leaf close switches 198, 199. Alternately, the switch set 190B can be separated into two sets, one for each door. The open switch 196 and close switch 198 are connected to the solenoids 104', 104", respectively, and the open switch 197 and close switch 199 are connected to the solenoids 106', 106", respectively. Activating the open switch 196 activates the valve 104 (via solenoid 104') and the motor to effect extension of the cylinders 70, 71 to open the leafs 60A, B. Activating the close switch 198 activates the valve 104 (via solenoid 104") and the motor to effect retraction of the cylinders 70, 71 to close the leafs 60A, B. Activating the open switch 197 activates the valve 106 (via solenoid 106') and the motor to effect extension of the cylinders 72, 73 to open the leafs 60C, D (FIG. 10). Activating the close switch 199 activates the valve 106 (via solenoid 106") and the motor to effect retraction of the cylinders 72, 73 to close the leafs 60C, D (FIGS. 8, 9). The switch set 190C is positioned on the return air side 18 at a location out of the path of leaf movement should the leafs 60C, D open into the return air side. The switch set 190C includes a leaf open switch 204, leaf close switch 205. Activation of the open switch 204 activates the valve 106 (via solenoid 106') to effect extension of the cylinders 72, 73 to move the leafs 60C, D to open positions. Activation of the close switch 205 activates the valve 106 (via solenoid 106") to effect retraction of the cylinders 72, 73 to close the leafs 60C, D. Stop switches 200, 206 (preferably of the momentary contact type) are provided and are preferably mounted in the housing 182. Activating the stop switch 200 de-energizes the solenoids 104', 104" of valve 104 to block the valve ports connected to the cylinders 70, 71 to stop extension or retraction of the cylinders to lock or positively maintain the cylinders and their respective leafs 60A, B at the stopped position. Activation of the stop switch 206 de-energizes both the solenoids 106', 106", to block the valve ports to and from the cylinders 72, 73 to stop extension or retraction of an extending or retracting cylinder 72, 73 to lock or positively maintain the cylinders and their respective leafs at the stopped position. At any time that there is no signal to open or close leafs, the leafs are locked in position, until released by re-energizing a solenoid or opening of a dump valve 160 A–D, since flow of fluid is blocked into and out of the respective cylinders.

One or more operating safety devices can be provided to improve safe operation of the mine door system 10. As shown, a "power on" indicator 210, such as a light, is provided to inform personnel that power is on to control circuit 180 and available for the motor 91. The motor 91 can be powered by activating any switch that will open or close any of the leafs 60A–D, including switches 192, 193, 196, 197, 198, 199, 204, 205 (which are momentary contact type switches) and other switch devices hereafter described. This is accomplished by activating the relay 211 and closing the contacts 211A–C. A main power switch 213 is also provided and includes contacts 213A–C. The power switch 213 is preferably mounted on or in the housing 182 and can be used to lock out power to the control circuit 180 and the motor 91. The motor 91 is safeguarded from overload by use of the overload switch 214 which if open, deactivates the relay 211 and opening the contacts 211A–C thereby terminating power to the motor. The overload switch 214 is preferably a manually resettable thermal overload switch that is conveniently mounted in the housing 182 and is operable to indirectly sense the load history of the motor 91 to determine if it is overheated.

Safety means is also provided to directly or indirectly determine if a leaf 60A–D has encountered an obstruction and, if one is encountered, such as a rock lodging under a leaf, the safety means is operable to disable the hydraulic system 89 as by turning off power to the motor 91 and de-energizing the solenoids 104', 104", 106' and 106" so the valves 104, 106 are in the blocked port condition to prevent damage to the door system 10 by locking the leafs in position. One means to sense an obstruction is the use of a timer 212. A suitable timer is model MP-JK401007 available from Jack Kennedy Metal Products & Buildings, Inc. The timer 212 can also be used to indirectly detect low hydraulic fluid which is indicated by the leafs taking too long to open. The timer 212 starts when at least one of the cylinders 70–73 commences extension or retraction. The timer 212 has a preset time period that exceeds the normal time needed for a leaf 60A–D to move from a closed position to an open position or from an open position to a closed position. Reaching an open or closed position is indicated by an increase in the hydraulic system pressure when a cylinder 70–73 reaches the end of extension or retraction. The increased pressure is sensed by a pressure switch 215 with two sets of contacts, 215A, B which turn off the motor when either is opened. If the preset time period of the timer 212 is exceeded, indirectly indicating a possibly blocked leaf, before the pressure switch 215 indicates that the cylinders have completely extended or retracted, indicating that a leaf has not reached its open or closed position, the motor 91 will be disabled by terminating power to it. If the timer 212 times out, the contacts 212A close to power the lamp 212L mounted on the housing 182 to indicate that the timer timed out, and the contacts 212C open terminating power to the motor 91 by de-energizing the relay 211. Opening of the contacts 212C also de-energizes the solenoids 104', 104", 106' and 106" . The contacts 212B close when the timer 212 times out to keep the timer energized for operation thus preventing further operation of the door until power is removed from the unit manually thru opening of switch 213. In the event of such a shutdown, the valves 104, 106, if not already there, will move to the blocked port position locking the leafs 60A–D in position. The control system could include an alarm activated by the timer 212 to inform personnel that a leaf may be obstructed and that inspection and clearing may be needed. Such an alarm may be transmitted to a manned control station remote from the door system 10. The pressure switch 215 will, in addition to indicating end of cylinder stroke, indicate an obstruction preventing leaf movement when the hydraulic pressure rises and reaches the preset value should a leaf stop moving or meet substantial resistance with continuing motion before the end of a stroke. The activation of the pressure switch 215 from the elevated hydraulic pressure will terminate power to the motor 91 by terminating power to the relay 211 (by opening the contacts 215A, 215B) and to the solenoids 104', 104", 106' and 106" causing the valves 104, 106 to move to their blocked port conditions, if not already there, and thereby positively stopping the leafs and locking them in position. The contacts 211A–G move to their open positions when the relay 211 is de-energized. The contacts 211D, 211E when closed keep the relay 211 energized and the motor 91 running.

Figure 4:
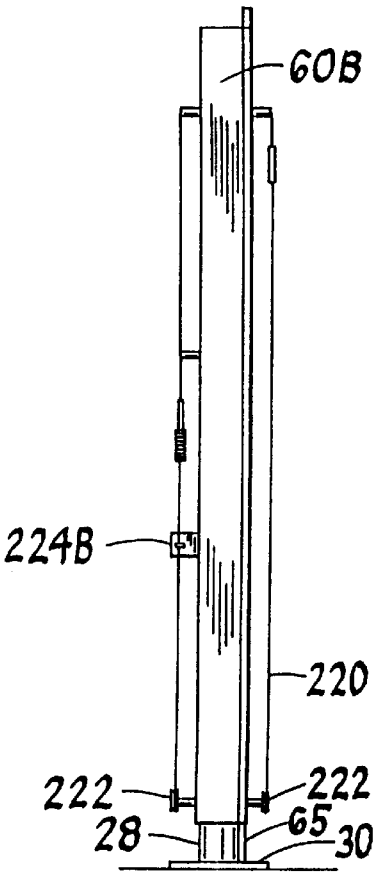
FIG. 4 is a view of a free end of a leaf showing details of a cable switch arrangement.

An additional safety device for leaf operation can be provided to sense obstructions directly. In one embodiment, a cable 220 tensioned with a spring 221 is mounted around at least a portion of the periphery of each of the leafs 60A–D and mounted in hangers 222, as best seen in FIGS. 3 and 4. The cables 220 are connected to switches 224A–D such as wand type limit switches. As best seen in FIG. 4, lengths of cable 220 are mounted on opposite faces of each leaf, with each length being connected to a respective switch 224A–D. The switches 224A–D are operable to sense a change in tension (an increase or decrease, cable 220, and if a sufficient change in tension is sensed, the motor 91 will be disabled by shutting off power thereto. Further, any of the cylinders 70–73 that were extending or retracting will stop movement (as will the respective leaf 60A–D connected thereto) and the valves 104, 106 will move to the blocked port condition, if not already there, thereby locking the leafs in position. An alarm could be provided to inform personnel that there is a possible leaf obstruction. Also, the cable 220 could be used by personnel in an emergency to stop movement of a leaf. When the motor 91 is energized by activation of the relay 211, the contacts 211F, G close and would energize the safety latch relays 225–1, 225–2 which would be held energized by the contacts 225–1A, 225–1B if contacts 299–1A and 299–2A were closed. A change in tension in the respective cable causes contacts 225D and 225G of safety fault relays to be opened to stop power to the motor 91. Note that relays 299–1 and 299–2 hold contacts 299–1A and 299–2A open during normal operation. Lights 226A, B respectively show that the relays 225–1, –2 are energized. When an obstruction is encountered, either of the switches 224A, B (mounted on leafs 60A, B) can de-energize the relay 299–1 when either is closed thereby closing the contacts 299–1A. Either of the switches 224C, D (mounted on leafs 60C, D) can de-energize the relay 299–2 when either is closed thereby closing the contacts 299–2A. If any of the conductors 227A–D is broken, the respective relay 299–1, –2 will also close the respective contacts 299–1A, –2A thereby turning off the motor 91 and allowing the valves 104, 106 to move to their blocked port positions if not already there. Current is supplied to the switches 224A–D through step-down transformers 223 through resistors R. The output voltage of the transformers 223 is preferably about 24V AC. The resistors R limit total current load and prevent overheating of the circuit sections containing the switches 224A–D when the switches are operated or in the event of a short circuit therein.

Normal operation of the mine door system 10 for ingress into and egress out of the air lock 24 is also controlled by the control system 180. It is preferred that the means to effect normal opening and closing of the leafs 60A–D be adapted for use by operators of various sizes of equipment and also by pedestrians. In a preferred embodiment, photocells 231–238 are used and function as switches thru relays (not shown). The photocells 231–238 are configured in two sets of four, with one set of four photocells 231–234 operating the leafs 60A, B and the other set of four photocells 235–238 operating the leafs 60C, D. The number of photocells can be reduced by half, two sets of two for the doors (one set of two for each door) thru the use of latching relays. A preferred photocell is a model MPH-4-2008, available from Jack Kennedy Metal Products & Buildings, Inc., that may be activated projecting light onto the photocell as for example by shining a miner's work light thereon. The photocell is a type that is constructed to be activated by light only when it is received close to normal to the sensing element. This can be accomplished by shielding the photocell sensor with a tubular shroud. Unless a light (e.g., a miner's work light) is aimed generally directly at the photocell sensor, the control circuit will not operate the cylinders 70–73 and their respective leafs 60A–D. Thus, pedestrians or equipment operators can activate the photocells by shining a light directly onto the photocell sensor while equipment headlights will not inadvertently activate the photocells.

In the preferred embodiment, as best seen in FIGS. 1 and 7, each door 20, 22 is controlled by two open photocells and two close photocells. The photocell configuration is the same for each door 20, 22 and will be described with regard to door 20 for convenience. An open photocell 231 and a close photocell 232 are located on the fresh air side 16 of the door 20 and an open photocell 233 and a close photocell 234 are located on the return air side of the door 20 (i.e., in the air lock space 25). The photocells 231–234 are located in the mine passage 14 where equipment operators and pedestrians can both conveniently shine a light on the desired photocell and thus activate the valve 104 to effect either the desired extension or retraction of the cylinders 70, 71. Activating either of the photocells 231, 233 will effect opening of the leafs 60A, B. Activating either of the photocells 232, 234 will effect closing of the leafs 60A, B. Thus, the leafs 60A, B can be opened and closed from either side of the door 20. By the use of photocells 231–234, activation of leaf opening and closing can be accomplished from a location remote from the photocells allowing both pedestrians and equipment operators to conveniently operate the door 20. Photocells also eliminate the inconvenience of pushbutton activators that are not easily used by both pedestrians and equipment operators because of the requirements of different locations to accommodate the different types of users.

In the control circuit 180 shown in FIGS. 7A and 7B, manual pushbuttons are provided for assisting in the repair or maintenance of the control circuit 180, the hydraulic system 89 and the doors 20, 22. The pushbuttons include door open and door close switches 240, 241 respectively for the door 20 and door open and door close switches 242, 243 respectively for the door 22. The switches 240–243 are preferably of the momentary contact type and are mounted inside the housing 182. The door 20 is opened by closing the switch 240 which energizes solenoid 104' and the relay 250 that closes the contacts 250A, B which places the timer 212 in the circuit and starts the motor. Energizing the relay 250 opens the contacts 250C to prevent energizing the close relay 251 and the solenoid 104". The door 20 is closed by closing the switch 241 to energize solenoid 104" and to energize the relay 251 which closes the contacts 251A and 251B to place the timer 212 in the circuit, starts the motor and opens the contacts 251C to prevent energizing the relay 250 and the solenoid 104'. The door 22 is opened by closing the switch 242 which energizes the solenoid 106' (to open the door) and the relay 252 that closes the contacts 252A, C to place the timer 212 in the circuit and starts the motor. When the relay 252 is activated, the contacts 252B open to prevent energizing the solenoid 106" and the relay 253. The door 22 is closed by closing the switch 243 to energize solenoid 106" and to energize the relay 253 which closes the contacts 253A, 253B to place the timer 212 in the circuit, starts the motor and opens the contacts 253C to prevent energizing the solenoid 106' and relay 252. Thus, the doors 20, 22 can be operated also from the housing 182 in addition to operation by the photocells or manual pushbuttons.

As many of the hydraulic control components of the hydraulic control system 89 and electrical control system components of the electrical control system 180 are enclosed in the housing 182 as practicable to separate them from the mine environment, particularly the dirt in the air. The cylinder 70–73, 160A–D are not, but the remaining components are and most preferably the electrically operated hydraulic components such as the valves 104, 106, pressure switch 215 and the motor 91 are enclosed in the housing 182. Further, as many of the components of the electrical system 180 as practicable are enclosed in the housing 182. The photocells and certain of the sensors, and switches are not in the housing, and are remote controllers that provide control signals to signal receiving portion of the circuit 180. The remote controllers include switches 192, 193, 196, 197, 198, 199, 204, 205, photocells 231, 232, 233, 234, 235, 236, 237, and 238, interlock switches 184A–D and switches 224A–D. The remainder of the circuit is the signal receiving portion and receives signals from the remote controllers and processes them to control operation of the motor and door actuators.

In view of the above, it will be seen that the several objects of the invention are achieved and other advantageous results attained.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A power operated mine door system forming an airlock space in a mine with at least one door of the mine door system being on a fresh air side of the mine door system, said mine door system comprising:

a plurality of doors mounted in a mine passage in spaced apart relation, each door including at least one leaf mounted for moving between open and closed positions, said doors forming an airlock with the airlock space therebetween, at least one door being a return air side door and at least one door being a fresh air side door;

a single source of pressurized fluid, said source including only one non-explosion proof motor and only one fluid pump driven by the motor, said motor being positioned in the mine passage on the fresh air side of the fresh air side door;

a plurality of actuators each operably connected to at least one leaf and to the single source of pressurized fluid to selectively apply driving force to at least one leaf and thereby move at least one leaf to at least one of said open and closed positions; and a control system operably connected to the actuators for selectively allowing pressurized fluid to flow to each said actuator for applying said driving force to a selected at least one leaf for moving it to at least one of its open and closed positions.

2. A mine door system as set forth in claim 1 wherein each leaf is mounted for swinging movement about a generally vertical axis and said actuators being operable to selectively retain the respective said at least one leaf in its open position and closed position.

3. A mine door system as set forth in claim 1 wherein said control system includes interlock means operable to prevent opening of said at least one leaf in one door if said at least one leaf in any other door is not in a closed position.

4. A mine door system as set forth in claim 1 having two of said doors.

5. A mine door system as set forth in claim 1 wherein a portion of said control system is contained in a non-explosion proof housing positioned in the mine passage on the fresh air side of the fresh air side door.

6. A mine door system as set forth in claim 1 wherein said actuators include piston cylinders.

7. A mine door system as set forth in claim 6 wherein said piston cylinders are double acting piston cylinders.

8. A mine door system as set forth in claim 1 wherein said fluid pump includes a hydraulic pump.

9. A mine door system as set forth in claim 8 wherein each door includes a pair of leafs.

10. A mine door system as set forth in claim 8 wherein said control system includes valves operable to selectively lock said leafs in said open and closed positions and any position between said open and closed positions.

11. A mine door system as set forth in claim 10 wherein said control system includes at least one valve operably connected to said cylinders to selectively allow fluid therein to flow from the cylinder and thereby unlock a locked leaf to allow it to move from its locked position.

12. A mine door system as set forth in claim 11 wherein said control system includes solenoid activated control valves operably connected to said cylinders for selectively controlling extension and retraction thereof to open and close said leafs, each leaf being locked in position when the solenoids of the valve controlling the cylinder connected to a leaf are not energized.

13. A mine door system as set forth in claim 12 wherein said control system includes means to de-energize any energized solenoid when a leaf encounters an obstruction to movement between its open and closed positions.

14. A mine door system as set forth in claim 13 wherein said de-energizing means includes a hydraulic pressure switch operable to sense pressure in a hydraulic system connecting said pump to said cylinders.

15. A mine door system as set forth in claim 14 wherein said solenoid valves include four way spring return solenoid valves each having a pair of solenoids and being operable when either of the solenoids of a valve is not energized, the respective valve is in a blocked port condition thereby blocking flow of fluid to and from a respective cylinder.

16. A mine door system as set forth in claim 15 wherein said de-energizing means includes a timer operable to de-energize any energized solenoid if a respective leaf does not complete opening or closing within a predetermined time period.

17. A mine door system as set forth in claim 12 wherein said control system includes a plurality of photocells operably connected to said solenoid valves for controlling operation thereof to effect extension and retraction of said cylinders, each of said doors having two pairs of photocells with a pair being mounted on each side of said door, each pair of photocells including an open photocell and a close photocell whereby said the leafs of each door can be opened and closed by activation of the respective open and close photocell by projecting light thereon on either side of the door.

18. A door system for a mine, said door system comprising:

at least one leaf mounted for pivotal movement between open and closed positions;

a power actuator operably connected to said leaf and operable to move said leaf between said open and closed positions;

a power source operably connected to said power actuator to provide pressurized fluid thereto to effect operation of said power actuator and thereby move said leaf between said open and closed positions;

a control system operably connected to said power source and said actuator to effect selective extension and retraction of the power actuator and to effect locking of said leaf in said open and closed positions and at positions therebetween, said control system including a timer operable to lock said leaf in position in response to the leaf exceeding a preset time period to move to the closed position or to the open position.

19. A door system for a mine as set forth in claim 18 wherein said door system includes a plurality of doors each including at least two of said leafs, said doors being adapted for mounting in a mine passage in spaced apart relation along the mine passage to form an airlock.

20. A door system for a mine as set forth in claim 18 wherein said control system includes photocells operable to effect extension or retraction of the power actuator to open or close said leaf in response to a light projected onto a respective photocell.

21. A door system for a mine as set forth in claim 18 wherein said control system is operable to lock said leaf in position in response to a signal generated manually.

22. A door system for a mine as set forth in claim 18 wherein said control system includes release means to selectively allow said leaf to be moved after being placed in a locked condition.

23. A door system for a mine as set forth in claim 22 wherein said power source includes a fluid pump, said power actuator includes a piston cylinder operably connected to said at least one leaf, and said release means includes a release valve connected to said cylinder and operable to selectively allow flow of fluid from said cylinder thereby selectively allowing movement of the leaf from its locked position.

24. A door system for a mine as set forth in claim 23 wherein said release valve includes at least one manual dump valve operable in the absence of electrical power.

25. A door system for a mine as set forth in claim 24 wherein said power source includes a non-explosion proof electric motor for positioning in a fresh air side of said mine passage.

26. A door system for mine as set forth in claim 25 wherein portions of said control system are mounted in a non-explosion proof housing for positioning in fresh air side of said mine passage.

27. A power operated mine door system forming an airlock space between a high pressure side and a low pressure side of the mine door system, said mine door system comprising:

a plurality of doors mounted in a mine passage in spaced apart relation, each of said doors including at least one leaf mounted for moving between open and closed positions, said doors forming an airlock with the airlock space therebetween;

a single source of pressurized fluid, said source including at least one motor and at least one fluid pump driven by said motor, said source being positioned on one side of one of said doors;

a plurality of actuators each operably connected to at least one leaf and to the single source of pressurized fluid to selectively apply driving force to at least one leaf and thereby move the leaf between said open and closed positions and to selectively retain the respective leaf in its open position and closed position; and a single control system operably connected to the actuators and said source for selectively allowing pressurized fluid to flow to the actuators for applying said driving force to at least one leaf for moving it to at least one of its open and closed positions, said control system including an interlock device including a sensor operably associated with each said leaf to provide a signal that the respective leaf is closed and prevent opening of the leaf in one door if any leaf in another door is not closed.

28. A mine door system as set forth in claim 27 wherein said source includes only one motor and only one fluid pump.

29. A mine door system as set forth in claim 28 wherein at least a portion of said control system is electrical and includes a signal receiving portion mounted in a housing.

30. A mine door system as set forth in claim 29 wherein said source is mounted in a housing.

31. A mine door system as set forth in claim 30 wherein said housing for the signal receiving portion and the housing for the-source are the same housing.

32. A power operated mine door system forming an airlock space between a high pressure side and a low pressure side of the mine door system, said mine door system comprising:

a plurality of doors mounted in a mine passage in spaced apart relation, each door including a leaf mounted for moving between open and closed positions, said doors forming an airlock with the airlock space therebetween;

a source of pressurized fluid, said source including at least one motor and at least one fluid pump driven by a said motor, said source being positioned on one side of one of said doors;

a plurality of actuators, each actuator operably connected to the leaf and to the source of pressurized fluid to selectively apply a driving force to the leaf and thereby move the leaf between said open and closed positions and selectively retain the leaf in its open position and closed position; and a single control system operably connected to the actuators and said source for selectively allowing pressurized fluid to flow to the actuators for applying said driving force to the leaf in one of said doors for moving it to at least one of its open and closed positions, said control system including an interlock device including a sensor operably associated with each of said leafs to provide a signal that the respective leaf is closed and prevent opening of the leaf in one of said doors if any leaf in another door is not closed, said single control system including a signal receiving portion mounted in a single housing enclosing the signal receiving portion therein.

33. A mine door system as set forth in claim 32 wherein said housing is a non-explosion proof housing for locating in a fresh air area of a mine.

34. A mine door system as set forth in claim 32 wherein said housing is an explosion proof housing for locating in a return air area of a mine.

35. A power operated mine door system forming an airlock space in a mine with at least one door of the mine door system being on a fresh air side of the mine door system, said mine door system comprising:

a plurality of doors mounted in a mine passage in spaced apart relation, each door including at least one leaf mounted for moving between open and closed positions, said doors forming an airlock with an airlock space therebetween, at least one door being a fresh air side door with fresh air on at least one side of a said fresh air side door;

a single source of pressurized fluid, said source including only one non-explosion proof motor and only one fluid pump driven by the motor, said motor being positioned in the mine passage on a fresh air side of a said fresh air side door;

a plurality of actuators each operably connected to at least one leaf and to the single source of pressurized fluid to selectively apply driving force to at least one leaf and thereby move at least one leaf to at least one of said open and closed positions; and a single control system operably connected to the actuators for selectively allowing pressurized fluid to flow to each said actuator for applying said driving force to a selected at least one leaf for moving it to at least one of its open and closed positions.

36. A system as set forth in claim 35 wherein there is only one control system, said control system comprising an interlock device including a sensor operably associated with said doors to provide a signal that one of said doors is open and to prevent opening of another of the doors.

37. A system as set forth in claim 36 wherein said control system includes a timer operable to lock said at least one leaf in position in response to said at least one leaf exceeding a preset time period to move to the closed position or to the open position.

38. A door system mounted in a mine passageway, said door system comprising:

a first door including a leaf mounted for pivotal movement between open and closed positions;

a power actuator operably connected to said leaf for moving said leaf between said open and closed positions;

a power source operably connected to said power actuator to provide pressurized fluid thereto to effect operation of said power actuator and thereby move said leaf between said open and closed positions;

a control system operably connected to said power source and said actuator to effect extension and retraction of the power actuator, the control system being adapted to regulate speed of extension and retraction for regulating leaf closing and opening speed and to inhibit uncontrolled movement of the leaf during opening and closing due to air pressure.

39. A door system as set forth in claim 38 wherein said power actuator is a double acting piston cylinder, the control system including a first variable flow control valve connected to one side of the cylinder for regulating leaf closing speed and a second variable flow control valve connected to an opposite side of the cylinder for regulating leaf opening speed.

40. A mine door system as set forth in claim 39 comprising a second door mounted in the mine passageway substantially identical to the first door and spaced from the first door to form an airlock.

41. A door system mounted in a mine passageway, said door system comprising:

a leaf mounted for pivotal movement between open and closed positions;

a piston cylinder operably connected to said leaf for moving said leaf between said open and closed positions;

a power source operably connected to said cylinder to provide pressurized fluid thereto to effect operation of said piston cylinder and thereby move said leaf between said open and closed positions;

a control system operably connected to said power source and said actuator to effect selective extension and retraction of the cylinder and effect locking of said leaf in said open and closed positions and at positions therebetween, said control system including a dump valve connected to said cylinder and operable to selectively allow flow of fluid from said cylinder thereby selectively allowing movement of the leaf from its locked position.

* * * * *